United States Patent [19]

Kirkor

[11] 4,319,229

[45] Mar. 9, 1982

[54] ALARM SYSTEM HAVING PLURAL DIVERSE DETECTION MEANS

[75] Inventor: Gabriel Kirkor, Elmont, N.Y.

[73] Assignee: Firecom, Inc., Woodside, N.Y.

[21] Appl. No.: 157,926

[22] Filed: Jun. 9, 1980

[51] Int. Cl.[3] ..... G08B 17/10; G08B 17/12; G08B 17/19

[52] U.S. Cl. ..... 340/521; 340/501; 340/517; 340/533; 340/577

[58] Field of Search ..... 340/500, 501, 517, 521, 340/522, 541, 565, 577, 578, 533, 579, 584

[56] References Cited

U.S. PATENT DOCUMENTS

| | | | |
|---|---|---|---|
| D. 238,057 | 12/1975 | Pearsall et al. | D10/106 |
| D. 241,824 | 10/1976 | Mackay | D10/106 |
| 3,312,826 | 4/1967 | Finkle | 250/218 |
| 3,313,946 | 4/1967 | Goodwin | 250/239 |
| 3,430,220 | 2/1969 | Deuth | 340/578 |
| 3,634,846 | 1/1972 | Fogiel | 340/521 |
| 3,665,440 | 5/1972 | McMenamin | 340/228.2 |
| 3,678,511 | 7/1972 | Benedict | 340/521 |
| 3,773,145 | 11/1973 | Drexler | 187/29 |
| 3,810,171 | 5/1974 | Schubert | 340/521 |
| 3,881,112 | 4/1975 | Roberts | 250/565 |
| 3,921,168 | 11/1975 | Dunbar | 340/533 |
| 4,178,522 | 12/1979 | MacLennan et al. | 250/338 |

*Primary Examiner*—Alvin H. Waring
*Attorney, Agent, or Firm*—Nolte and Nolte

[57] ABSTRACT

A system for detecting a fire emergency condition employs three separate and diverse sensors; a heat detector, a smoke detector, and an infrared radiation detector. Either or all of these detectors can activate the alarm. Additionally, the infrared radiation detector can be used to control the energization of the room's artificial illumination means. All sensors are mounted in a common housing and a mirror or lens arrangement is provided to focus the infrared radiation upon the appropriate detector.

14 Claims, 4 Drawing Figures

ALARM OR REMOTE ANNUNCIATOR
34
DISCRIMINATOR CIRCUIT
50
SWITCH/RELAY FOR LIGHTING
40
LIGHTING
SMOKE DETECTOR
12
HEAT DETECTOR
14
INFRARED DETECTOR
48
10
18
20
22
24
26
28
42
44
52
54
56
58
60
62

ALARM OR REMOTE ANNUNCIATOR
34
SWITCH/RELAY FOR LIGHTING
40
LIGHTING
46
SMOKE DETECTOR
12
HEAT DETECTOR
14
INFRARED DETECTORS
16
10
18
20
22
24
26
28
30
32
36
38
42
44

ALARM SYSTEM HAVING PLURAL DIVERSE DETECTION MEANS

BACKGROUND OF THE INVENTION

The present invention relates to detection systems in general and, more specifically, relates to a fire emergency detection system wherein a number of diverse detectors are employed to signal a fire emergency condition.

There have been countless approaches toward detecting smoke and fire in buildings and recent advances in technology have permitted conventional smoke detectors to be reduced in price by such an amount that they are prevelant throughout the country. Such smoke detectors typically sound an audible alarm to warn the occupants of the dwelling of a fire emergency condition.

Additionally, there have been developed several different approaches for use in large buildings and for industrial applications, which detect heat or smoke in order to signal an impending emergency condition. Generally, a large number of detection units are employed, one located in each room or hallway of the building. These detection units are connected to a central control panel which serves to indicate the exact location of the fire. Certain operating systems in the building, such as the elevator system or ventilation system, can also be controlled by the detection units. Typical of such systems is that disclosed in U.S. Pat. No. 3,634,846 issued to Fegiel.

Such existing systems usually depend upon one specific type of detection approach, e.g., a radioactive element smoke detector. Nevertheless, there has been proposed a fire detector having a multi-mode input sensing system, wherein plural detectors of different types are used to detect a fire condition. This system is shown in U.S. Pat. No. 3,430,220 issued to Deuth.

SUMMARY OF THE INVENTION

The present invention provides a detection system for detecting an emergency fire condition, which employs three separate kinds of detectors. The invention includes a smoke detector, a heat detector, and an infrared radiation detector, all combined to provide a signal to an alarm unit or remote annunciator unit.

Additionally, the use of infrared detectors permits the inventive system to detect the presence of persons within the purview of the detection system. Thus, the invention also provides intrusion detection capabilities not heretofore found in conventional fire emergency detectors.

A further feature of the present invention is the use of the infrared detectors to sense the presence of persons within the room or area being monitored and to use these detectors to turn on or off the room lighting, thereby providing a means of conserving electrical power and energy. The invention also is provided with a means to improve the field of vision of the infrared sensor, thereby permitting the use of fewer detection units and also to make the placement of the system in the room more flexible. Upon detecting the presence of a person in the room, a signal is provided to a relay system which can be used to control the area lighting.

The present invention is particularly intended for use with systems installed in apartment buildings or office buildings, wherein a large number of detection units are connected to a central control panel or annunciator panel. Accordingly, while the present invention could operate on battery power, it is preferably operated from either the conventional 110 volt a.c. or the readily available 24 volts a.c.

Therefore, it is an object of the present invention to provide a fire emergency alarm and protection system employing a number of diverse sensing means.

It is another object of the invention to provide a fire emergency detecting system employing an infrared detection system for detecting the presence of fire and for sensing the presence of persons within the monitored area and controlling the illumination means for the area.

It is another object of the present invention to provide a fire emergency detection system employing an infrared radiation detector which utilizes apparatus to focus all available infrared radiation from substantially all portions of the monitored area onto the one or more infrared detectors.

The manner in which these and other objects are accomplished by the present invention will become clear from the following detailed description.

DETAILED DESCRIPTION OF THE DRAWINGS

Figure 1:
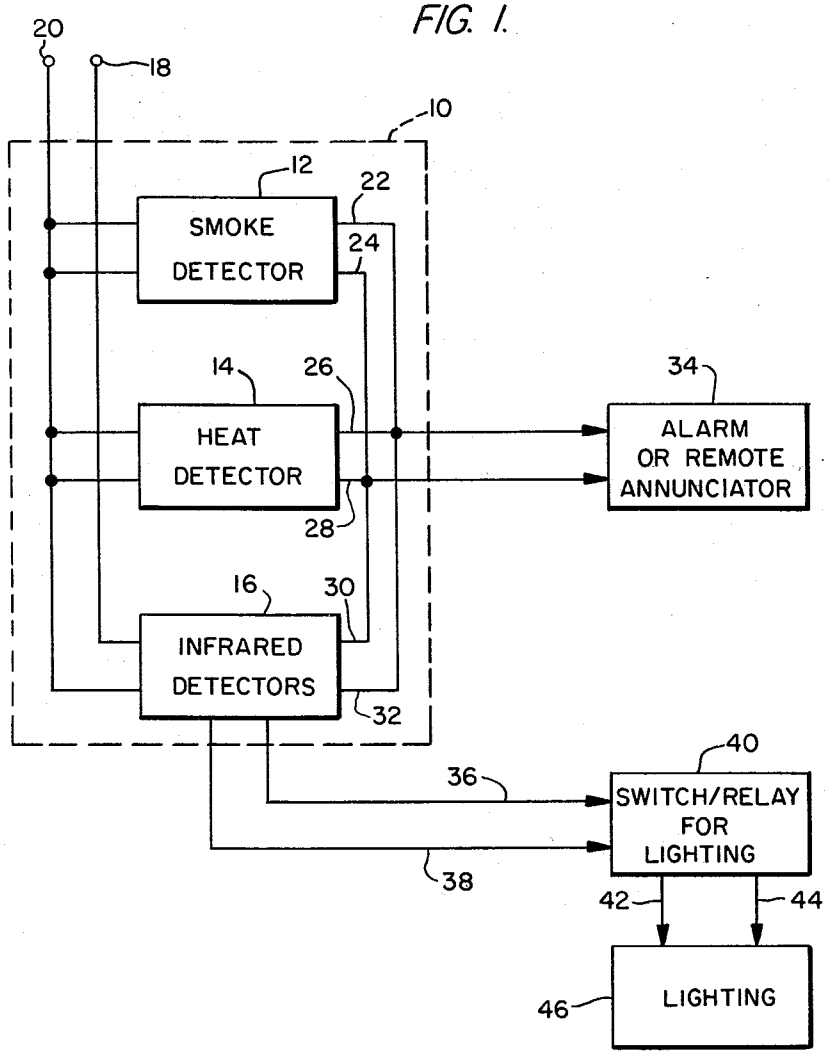
FIG. 1 is a schematic in block diagram form of the inventive detection system.

Referring now to FIG. 1, a schematic in block diagram form showing the essential electric connections of one embodiment of the invention is set forth. The actual detecting means, which are normally grouped together, are shown enclosed by dashed line 10. In the instant embodiment the several detecting means include a smoke detector 12, a heat detector 14, and an infrared detector 16. These three detectors 12, 14, and 16 are powered by the available a.c. power on lines 18 and 20. The three detectors 12, 14, and 16 provide output signals on lines 22 and 24, 26 and 28, and 30 and 32, respectively. The outputs from these three detectors 12, 14, 16 are fed to either a local or remote alarm system or annunciator, shown generally at 34. In a large installation, it is understood that various systems are known for connecting a number of emergency detectors 10 to a single control panel 34 without the requirement for the number of individual wires to equal the number of detectors, such a system is described, for example, in U.S. Pat. No. 3,921,168, assigned to the assignee hereof. The three separate detecting means can be connected to the alarm unit by common connections because all that is required to signal a fire emergency condition is that one of the detecting means be activated.

In order to accomplish controlling the artifical lighting in the area being monitored, there are at least two approaches which may be followed. FIG. 1 shows one such approach. Specifically, the infrared detector unit 16 comprises at least two infrared detector elements. One detector element is connected to the alarm 34 by lines 30, 32. This element signals a fire emergency when activated. The embodiment of FIG. 1 assumes that levels of infrared radiation at which each element produces an output are different. This can be easily achieved by optical filtering. Specifically, the element connected to the alarm 34 requires a higher level of infrared radiation than does the element producing an indication of the presence of a person. The alarm unit 34 and the switch/relay unit 40 are selected to be compatible with the appropriate outputs from the detector elements. The second infrared element in the infrared detector unit 16 is connected by leads 36, 38 to a switch or relay apparatus 40 which is used to control the artificial lighting in the monitored area. The switch/relay 40 may include a latch or the like so that it can remember its previous state and thus either turn on or turn off the lights by signals on lines 42 and 44, which are connected to the energization switches for the artificial lighting, shown schematically at 46.

Figure 2:
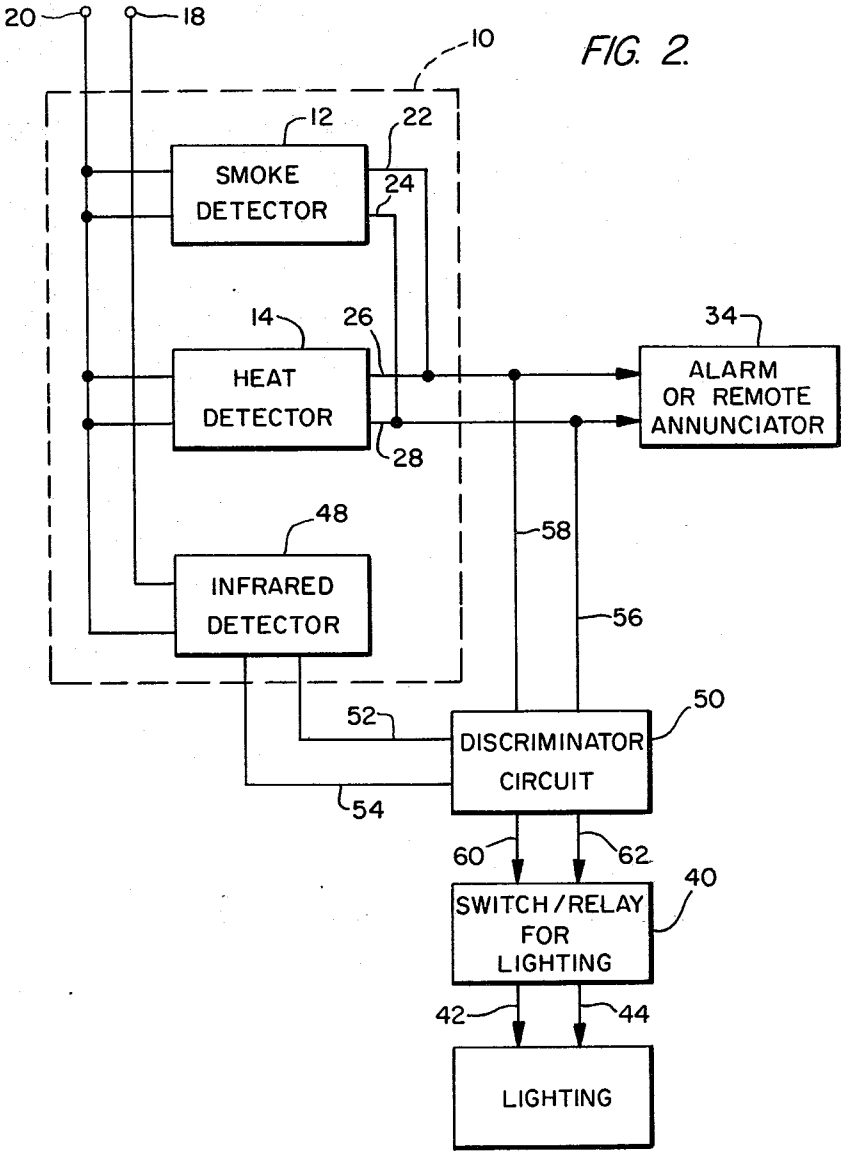
FIG. 2 is a schematic block diagram form of another embodiment of the inventive detection system.

In the embodiment of FIG. 2, the infrared detector unit 48 includes only one infrared sensitive element. It being understood that while only one element is described it may include several discrete devices interconnected and constructed to form a unit having a single electrical output. Because the infrared detector unit 48 employs only a single infrared sensing element, a discriminator circuit 50 is required to prevent the situation where a person entering the area will set off the fire alarm 34. The infrared detector unit 48 is connected to the discriminator circuit 50 by lines 52, 54. The discriminator circuit 50 then produces alarm signals on lines 56, 58 when infrared detector unit 48 senses a fire in the monitored area and produces lighting control signals on lines 60, 62 when a person or persons are detected entering or exciting the monitored area.

It is assumed that the infrared detector 48 produces a signal having a first output level when the infrared radiation produced by a person or persons is incident thereon and a second level, different than the first level, when the much larger amount of infrared radiation from a fire is incident thereon. Therefore, the design of the discriminator circuit 50 is straightforward and may include a conventional level sensing circuit built around ordinary voltage comparators.

Alternatively, the discriminator circuit 50 is not employed and the output from the infrared element 48 is greater when radiation emitted by a fire is present than when infrared radiation emitted by a person is incident thereon, then this will result in the lights being turned on when a fire is sensed, provided that a latch or the like is used to sense the state of the switch 40 so that the lights are not turned off if a fire is detected.

Figure 3:
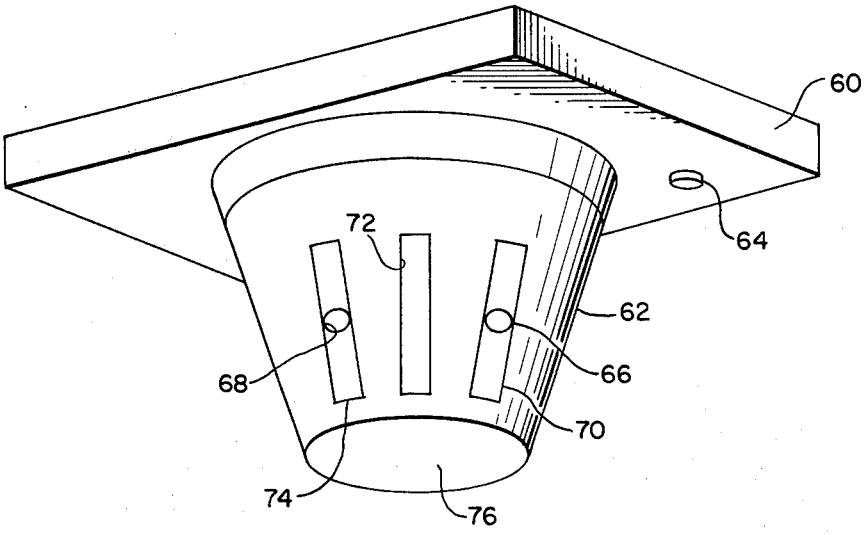
FIG. 3 is a perspective of an embodiment of the sensing portion of the present invention.

FIG. 3 is a perspective of an embodiment of the present invention, which comprises a base member 60 intended to be affixed to the ceiling of the room wherein the inventive detector unit is to be located. It is understood that before attaching the base member 60 to the ceiling, the proper electrical connections are made at a junction box or the like in the ceiling and thus are hidden from view in FIG. 3 by the base member 60. Arranged on the base member 60 is a body portion 62, which is preferably detachably affixed to the base 60. A pilot light 64 is provided to indicate that the system is energized and is operable. Located inside the body 62 are the smoke detector, the heat detector and, in this embodiment, the infrared detectors seen at 66 and 68. These detectors 66, 68 are located in three slots 70, 72, and 74 formed in the body 62 and it is understood that these slots are located around the entire circumference of the body portion 62. Accordingly, additional infrared sensors may also be arranged in the appropriate slots depending upon the field of view which is desired for the detector unit. Additionally, these slots 70, 72 and 74 permit entry of smoke and hot air into the body 62 so as to be sensed by the smoke detector and the heat detector located therein. The downwardly facing end portion 76 of the body 62 may also be provided with slots or apertures formed therein to admit smoke and heated air to the interior of the body 62. Alternatively, the downwardly facing portion 76 may be replaced by a lens or mirror arrangement, which will be shown in FIG. 4, and in that embodiment the infrared sensors may be located entirely inside the body 62, with the mirror or lens acting to focus the infrared radiation in the room onto the appropriate detectors.

The present invention does not depend upon the specific type of infrared detector employed. For example, either a thermal detector, which uses the power of the radiation to increase the temperature of the detecting element, or a photo-detector type infrared detector, wherein the radiation produces a direct effect on an electrical property of the detector, may be employed.

Figure 4:
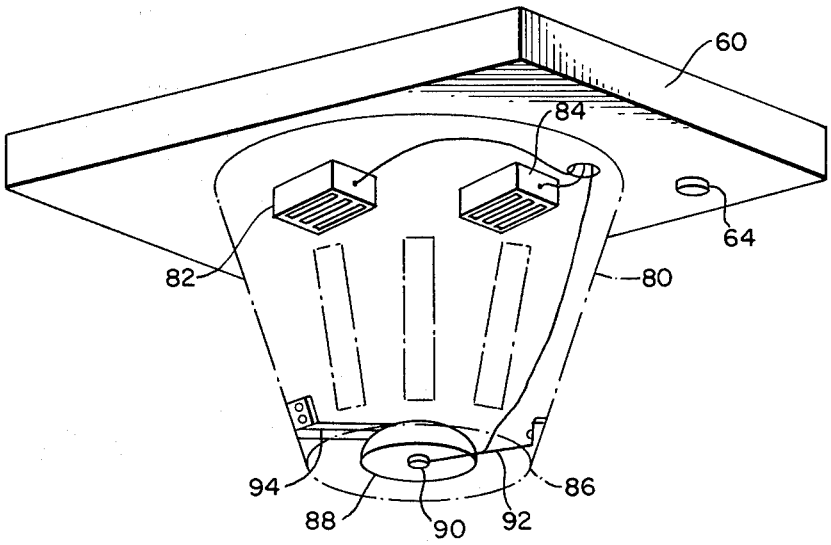
FIG. 4 is a perspective of another embodiment of the sensing portion of the present invention.

Referring now to FIG. 4, another embodiment of the inventive smoke and fire detector is shown. In this embodiment, the identical base member 60 may be employed along with a suitable pilot light 64. The body member employed in this embodiment is shown in phantom at 80, so that the manner in which the various diverse sensing elements are arranged inside the body may be seen. In this regard, a smoke detector 82 is shown and this smoke detector may be the conventional radioactive element type, a cloud chamber type, or any other kind of smoke detector. Additionally, arranged inside the housing 80 is a thermal detector 84 which also may be of a conventional type employing a diaphragm or similar mechanism which alters its shape upon being exposed to high temperatures. In the embodiment of FIG. 4, the body 80 is provided with a substantially open downwardly facing area 86 and located in this opening is a spherical mirror 88. This mirror 88 serves to focus all available infrared radiation in the room onto the infrared detector cell 90 which is mounted by means of a support 92 at the focal point of the spherical mirror 88. Although a spherical mirror 88 is shown in this embodiment, it is understood that various other types of mirror constructions could be provided, such as a parabolic mirror. The mirror is mounted by means of a suitable bracket 94 inside the housing 80. Because this arrangement detects infrared radiation, the mirror 88, sensor 90, and brackets 92, 94 can be hidden from view by a plastic cover, not shown, formed of material which is opaque to visible light and transparent to infrared radiation.

Alternatively, as indicated above, it is possible to employ a lens system at the lower end 86 of the housing 80 and, in this instance, the infrared radiation detection cell 90 would be located at the focal point of the particular lens used. Typical of such lenses might be a condensor lens formed of quartz crystal glass which has a transmission of almost 100% of infrared radiation.

In the embodiment of FIG. 4 only a single infrared radiation detecting cell is employed and in this regard the cell is chosen to be sensitive enough to detect the infrared radiation produced by a person, as well as being capable of handling the much larger levels of infrared radiation produced by a fire. If only one cell is used, then a simple level-discrimination circuit is employed so that the inventive system is able to distinguish between a person entering a room in order to turn on the lights and an actual fire wherein an alarm signal will be sent. Alternatively, two cells could be provided having different thresholds and could be both located side by side at the focal point of the mirror 88. Although only a single lead has been shown coming from the different detectors in the embodiment of FIG. 4, it is understood that in the typical installation the wiring will be done in accordance with the schematic of FIG. 1 or 2.

In the operation of the inventive system, a suitable number of units, such as shown in FIG. 4, are installed on the ceiling or walls of the area to be monitored by the inventive system, the appropriate power connections are made, and the units are connected to the central control panel or to individual alarm units. Upon the occurrence of a fire in the area in which the units have been installed, the smoke detector will act to detect the smoke produced by the fire. Additionally, in the event that the fire is of a nature wherein a quantity of heat is produced without a large quantity of smoke, then the heat detector will also provide an alarm. Should a fire be burning but be arranged such that the smoke is not conducted towards the smoke detector and the majority of the heat is conducted away with the smoke, then the infrared radiation detector has a low enough threshold that it will sense the infrared radiation produced by the fire and provide the alarm signal, even though most of the heat is conducted away from the detection unit.

It is understood that the thresholding system employed with the infrared radiation detection system can be constructed so when a person enters the room and no fire is present, then the infrared radiation sensor will detect the low level of infrared radiation produced by the human body and will not provide an alarm signal indicating a fire emergency. Rather, the system will provide a signal to a relay or switch means which will turn on the interior lights and ultimately turn off the interior lights once the infrared radiation emitted by the person's body is no longer present in the room.

Additionally, the detectors could also be employed to send out signals which would cause other operations to occur such as turning off fans, controlling elevators, or the like.

It is understood, of course, that the foregoing description is presented by way of example only and is not intended to limit the scope of the present invention, except as set forth in the appended claims.

What is claimed is:

1. A detection system for use in an area having controlled artificial lighting, comprising:

smoke detector means having an altered electrical characteristic in the presence of smoke;

heat detector means having an altered electrical characteristic upon the ambient temperature exceeding a predetermined level;

infrared radiation detector means having altered electrical characteristics upon the presence of a predetermined level of infrared radiation;

alarm means electrically connected to said smoke detector, means, said heat detector means, and said infrared radiation detector means, said alarm means being responsive to each of said altered electrical characteristics of said smoke detector means, said heat detector, and said infrared radiation detector, whereby upon the occurrence of any of said altered electrical characteristics said alarm means produces an alarm signal; and means electrically connected to said infrared radiation detector means being responsive to said altered electrical characteristics thereof for controlling the operation of the artificial lighting.

2. The system of claim 1, further comprising means for remotely locating said alarm means in relation to said smoke detector means, said heat detector means, and said infrared radiation detector means.

3. The system of claim 1, further comprising a housing which encases said smoke detector means and said heat detector means and which partially encases said infrared radiation detector means, said housing including a plurality of apertures arranged therein to admit ambient air into the interior of said housing casing for impingement by the ambient air upon said heat detector means and said smoke detector means.

4. The system of claim 1, wherein said infrared detector means includes two infrared sensors, one of said sensors being electrically connected to said alarm means, and the other of said sensors being connected to said means for controlling the operation of the artificial lighting.

5. The system of claim 1, wherein said infrared radiation detector means produces first altered electrical characteristics upon the presence of radiation below the predetermined level and second altered electric characteristics above the predetermined level and wherein said means for controlling the artificial lighting includes means for determining whether the radiation is above or below the predetermined level and for producing first and second signals, respectively, said first signal connected to said alarm means and said second signal connected to said controlled artificial lighting.

6. The apparatus of claim 1, further including a housing having a plurality of apertures formed therein and having said smoke detector means, said heat detector means, and said infrared radiation detection means arranged thereinside.

7. The apparatus of claim 1 further including means for focusing available infrared radiation upon said infrared radiation detector means.

8. The apparatus of claim 7, wherein said means for focusing includes a mirror.

9. The apparatus of claim 7, wherein said means for focusing includes a lens.

10. Apparatus for use in a room having controlled artificial lighting, comprising:

smoke detector means having altered electrical characteristics in the presence of smoke;

heat detector means having altered electrical characteristics upon the ambient air exceeding a predetermined temperature;

infrared radiation detection means having altered electrical characteristics dependent upon the level of infrared radiation incident thereon;

discriminator means connected to said infrared radiation detector means for producing a first output signal upon the presence of a first altered electrical condition for producing a first output signal upon the occurrence of a first altered electrical characteristic indicating the presence of a person and for producing a second output signal upon the occurrence of a second altered electrical characteristic indicating the presence of a fire;

alarm means connected to said smoke detector means, said heat detector means, and to said first output signal of said discriminator means and being responsive to said altered electrical characteristics of said smoke detector means and said heat detector means and to said first output signal from said discriminator means for producing an alarm; and artificial illumination control means connected to said second output signal of said discriminator means for controlling the energization or deenergization of the artificial illumination dependent upon the presence of said second output signal.

11. The apparatus of claim 10, further including a housing means having a plurality of apertures formed therein and having said smoke detector means, said heat detector means, and said infrared radiation detection means arranged therein.

12. The apparatus of claim 11, wherein said housing means includes means for focusing available infrared radiation upon said infrared radiation detection means.

13. The apparatus of claim 12, wherein said means for focusing includes a spherical mirror.

14. The apparatus of claim 13, wherein said infrared radiation detection means is arranged at the focal point of said mirror.

* * * * *